US011125233B2

(12) United States Patent
Su et al.

(10) Patent No.: US 11,125,233 B2
(45) Date of Patent: Sep. 21, 2021

(54) COMPRESSOR HAVING OIL ALLOCATION MEMBER

(71) Applicant: Emerson Climate Technologies, Inc., Sidney, OH (US)

(72) Inventors: Xiaogeng Su, Mechelen (BE); Zhenfei Duan, Suzhou (CN); Yan Chen, Suzhou (CN); Bin Li, Suzhou (CN); Yinglin Yu, Suzhou (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 83 days.

(21) Appl. No.: 16/829,303

(22) Filed: Mar. 25, 2020

(65) Prior Publication Data

US 2020/0309132 A1 Oct. 1, 2020

(30) Foreign Application Priority Data

Mar. 26, 2019 (CN) ..... 201910232919.6
Mar. 26, 2019 (CN) ..... 201920396278.3

(51) Int. Cl.
*F04C 29/02* (2006.01)
*F04C 18/02* (2006.01)
*F04C 29/00* (2006.01)

(52) U.S. Cl.
CPC ..... *F04C 29/023* (2013.01); *F04C 18/0215* (2013.01); *F04C 29/0057* (2013.01);
(Continued)

(58) Field of Classification Search
CPC ..... F04C 29/02; F04C 29/023; F04C 29/028; F04C 2240/603; F04C 18/0215
See application file for complete search history.

(56) References Cited

U.S. PATENT DOCUMENTS 3,229,901 A 1/1966 Parker
3,334,808 A 8/1967 Parker et al.
(Continued)

FOREIGN PATENT DOCUMENTS

CN 2081885 U 7/1991
CN 1127541 A 7/1996
(Continued)

OTHER PUBLICATIONS

International Search Report and Written Opinion of the ISA regarding Application No. PCT/US2020/024904 dated Jul. 15, 2020.
(Continued)

*Primary Examiner* — Mark A Laurenzi
*Assistant Examiner* — Xiaoting Hu
(74) *Attorney, Agent, or Firm* — Harness, Dickey & Pierce, P.L.C.

(57) ABSTRACT

A compressor may include a compression mechanism, a driveshaft, and an oil allocation member. The driveshaft drives the compression mechanism and includes a lubricant passage having an inlet and first and second outlets. The first outlet is disposed vertically higher than the inlet and the second outlet is disposed vertically higher than the first outlet. The oil allocation member is disposed within the lubricant passage. The oil allocation member may define first, second and third channels. The first channel extends through a lower axial end of the oil allocation member. The second channel receives a first portion of the lubricant from the first channel. The third channel receives a second portion of the lubricant from the first channel. The first and second portions of the lubricant may be separated from each other at a location that is vertically higher than the first outlet.

23 Claims, 8 Drawing Sheets

(52) U.S. Cl.
CPC ..... *F04C 29/028* (2013.01); *F04C 2240/50* (2013.01); *F04C 2240/603* (2013.01)

(56) References Cited

U.S. PATENT DOCUMENTS

| | | | | |
|---|---|---|---|---|
| 3,448,918 | A | 6/1969 | Cawley | |
| 3,465,954 | A | 9/1969 | Ellis | |
| 3,545,891 | A | 12/1970 | Parker | |
| 3,584,980 | A | 6/1971 | Cawley et al. | |
| 3,586,456 | A | 6/1971 | Giacosa | |
| 3,663,127 | A | 5/1972 | Cheers | |
| 4,065,279 | A | 12/1977 | McCullough | |
| 4,421,453 | A | 12/1983 | Hoff et al. | |
| 4,449,895 | A | 5/1984 | Kurahayashi | |
| 4,456,437 | A | 6/1984 | Kurahayashi et al. | |
| 4,462,772 | A | 7/1984 | Hazaki et al. | |
| 4,551,082 | A | 11/1985 | Hazaki et al. | |
| 4,564,339 | A | 1/1986 | Nakamura et al. | |
| 4,568,253 | A | 2/1986 | Wood | |
| 4,592,703 | A | 6/1986 | Inaba et al. | |
| 4,609,334 | A | 9/1986 | Muir et al. | |
| 4,639,194 | A | 1/1987 | Bell, III et al. | |
| 4,702,682 | A * | 10/1987 | Inaba | F04C 29/023 418/55.6 |
| 4,792,296 | A | 12/1988 | Kobayashi et al. | |
| 5,017,108 | A | 5/1991 | Murayama et al. | |
| 5,176,506 | A | 1/1993 | Siebel | |
| 5,221,191 | A | 6/1993 | Leyderman et al. | |
| 5,322,420 | A | 6/1994 | Yannascoli | |
| 5,368,446 | A | 11/1994 | Rode | |
| 5,385,453 | A | 1/1995 | Fogt et al. | |
| 5,391,066 | A | 2/1995 | Sawai et al. | |
| 5,445,507 | A | 8/1995 | Nakamura et al. | |
| 5,494,422 | A | 2/1996 | Ukai et al. | |
| 5,533,875 | A | 7/1996 | Crum et al. | |
| 5,553,465 | A | 9/1996 | Fukuda et al. | |
| 5,707,220 | A | 1/1998 | Krueger et al. | |
| 5,810,572 | A | 9/1998 | Yamamoto et al. | |
| 5,997,258 | A | 12/1999 | Sawyer, III et al. | |
| 6,039,551 | A | 3/2000 | Takeuchi et al. | |
| 6,264,446 | B1 | 7/2001 | Rajendran et al. | |
| 7,317,041 | B2 | 1/2008 | Guffogg et al. | |
| 7,381,040 | B2 | 6/2008 | Ogasawara et al. | |
| 7,566,210 | B2 | 7/2009 | Elson et al. | |
| 7,789,616 | B2 | 9/2010 | Yen et al. | |
| 9,217,434 | B2 | 12/2015 | Han et al. | |
| 2004/0219048 | A1* | 11/2004 | Tsuchiya | F04C 18/0215 418/55.4 |
| 2005/0053508 | A1 | 3/2005 | Morozumi et al. | |
| 2005/0069443 | A1 | 3/2005 | Uekawa et al. | |
| 2007/0071627 | A1 | 3/2007 | Lee et al. | |
| 2007/0183917 | A1 | 8/2007 | Um | |
| 2012/0263609 | A1* | 10/2012 | Han | F04C 23/008 417/372 |
| 2015/0044019 | A1 | 2/2015 | Wu et al. | |
| 2016/0201673 | A1 | 7/2016 | Perevozchikov et al. | |
| 2016/0208803 | A1* | 7/2016 | Uekawa | F04C 18/0215 |

FOREIGN PATENT DOCUMENTS

| | | | | |
|---|---|---|---|---|
| CN | 101303018 | A | 11/2008 | |
| CN | 202152734 | U | 2/2012 | |
| CN | 202300924 | U | 7/2012 | |
| CN | 102734170 | A | 10/2012 | |
| CN | 103790830 | A * | 5/2014 | |
| CN | 103790830 | B | 5/2016 | |
| CN | 205578273 | U | 9/2016 | |
| CN | 107559203 | A | 1/2018 | |
| CN | 206889250 | U | 1/2018 | |
| JP | S58214692 | A | 12/1983 | |
| JP | S6220689 | A | 1/1987 | |
| JP | H01257787 | A | 10/1989 | |
| JP | H0427788 | A | 1/1992 | |
| JP | H09177688 | A | 7/1997 | |
| JP | H11280668 | A | 10/1999 | |
| JP | 2009127614 | A | 6/2009 | |
| JP | 2012002227 | A | 1/2012 | |
| JP | 2016160774 | A | 9/2016 | |
| WO | WO-2013007163 | A1 | 1/2013 | |
| WO | WO-2020061998 | A1 * | 4/2020 | F04C 23/008 |

OTHER PUBLICATIONS

International Search Report regarding International Application No. PCT/US2012/031621, dated Oct. 12, 2012.
Written Opinion of the International Searching Authority regarding International Application No. PCT/US2012/031621, dated Oct. 12, 2012.
Office Action regarding Chinese Patent Application No. 201110089527.2, dated May 5, 2014. Translation provided by Unitalen Attorneys At Law.
Office Action regarding Chinese Patent Application No. 201110089527.2, dated Sep. 24, 2014. Translation provided by Unitalen Attorneys At Law.
Search Report regarding European Patent Application No. 12765121.4, dated Dec. 11, 2014.
Restriction Requirement regarding U.S. Appl. No. 14/355,793, dated Mar. 31, 2017.
Office Action regarding U.S. Appl. No. 14/355,793, dated Sep. 7, 2017.
Office Action regarding U.S. Appl. No. 14/355,793, dated Mar. 19, 2018.
Office Action regarding Indian Patent Application No. 1785/MUMNP/2013, dated May 23, 2018.
Advisory Action regarding U.S. Appl. No. 14/355,793, dated Jun. 12, 2018.
Office Action regarding U.S. Appl. No. 14/355,793, dated Aug. 9, 2018.
Applicant-Initiated Interview Summary regarding U.S. Appl. No. 14/355,793, dated Jan. 14, 2019.
Office Action regarding U.S. Appl. No. 14/355,793, dated May 16, 2019.
International Search Report regarding International Application No. PCT/CN2018/108228, dated Jun. 21, 2019.
Written Opinion of the International Searching Authority regarding International Application No. PCT/CN2018/108228, dated Jun. 21, 2019.
Applicant-Initiated Interview Summary regarding U.S. Appl. No. 14/355,793, dated Aug. 6, 2019.
Office Action regarding U.S. Appl. No. 14/355,793, dated Nov. 29, 2019.
Advisory Action regarding U.S. Appl. No. 14/355,793, dated Feb. 20, 2020.

* cited by examiner

COMPRESSOR HAVING OIL ALLOCATION MEMBER

CROSS-REFERENCE TO RELATED APPLICATIONS

This application claims the benefit and priority of Chinese Application No. 201910232919.6, filed Mar. 26, 2019, and Chinese Application No. 201920396278.3, filed Mar. 26, 2019. The entire disclosures of each of the above applications are incorporated herein by reference.

FIELD

The present disclosure relates to a compressor, and more particularly, to a compressor having an oil allocation member.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

The present disclosure provides a compressor that may include a compression mechanism, a driveshaft, and an oil allocation member. The driveshaft drivingly engages the compression mechanism and includes a lubricant passage. The lubricant passage includes an inlet, a first outlet, and a second outlet. The inlet and the first and second outlets are spaced apart from each other in a direction parallel to a rotational axis of the driveshaft such that the first outlet is disposed vertically higher than the inlet and the second outlet is disposed vertically higher than the first outlet. The oil allocation member may be disposed within the lubricant passage and may be fixed relative to the driveshaft. The oil allocation member may include a lower body portion and an upper body portion and may define a first channel, a second channel, and a third channel. The first channel may extend through a lower axial end of the oil allocation member and may receive lubricant flowing upward from the inlet of the lubricant passage. The second channel may receive a first portion of the lubricant from the first channel through an inlet of the second channel. The third channel may receive a second portion of the lubricant from the first channel through an inlet of the third channel. The inlets of the second and third channels may be disposed vertically higher than the first outlet. The lower body portion of the oil allocation member may separate the first channel from the first outlet of the lubricant passage.

In some configurations of the compressor of the above paragraph, the inlets of the second and third channels are disposed between the first and second outlets in the direction parallel to a rotational axis of the driveshaft.

In some configurations of the compressor of any one or more of the above paragraphs, the first portion of the lubricant and the second portion of the lubricant are separated from each other at a location that is vertically higher than the first outlet.

In some configurations of the compressor of the above paragraph, the location at which the first portion of the lubricant and the second portion of the lubricant are separated from each other is vertically lower than the second outlet.

In some configurations of the compressor of any one or more of the above paragraphs, the oil allocation member includes a divider wall that separates the inlet of the second channel from the inlet of the third channel and restricts fluid communication between the second and third channels.

In some configurations of the compressor of any one or more of the above paragraphs, the third channel extends through an upper axial end of the upper body portion.

In some configurations of the compressor of any one or more of the above paragraphs, the first outlet of the lubricant passage extends radially outward through an outer circumferential surface of the driveshaft.

In some configurations, the compressor of any one or more of the above paragraphs may include a bearing rotatably supporting the driveshaft.

In some configurations of the compressor of any one or more of the above paragraphs, the first outlet of the lubricant passage may be aligned with the bearing to provide lubricant to the bearing.

In some configurations of the compressor of any one or more of the above paragraphs, the second outlet of the lubricant passage extends through an upper axial end of the driveshaft.

In some configurations of the compressor of any one or more of the above paragraphs, the upper axial end of the driveshaft is disposed within a hub of a scroll member of the compression mechanism.

In some configurations of the compressor of any one or more of the above paragraphs, the compression mechanism is a scroll compression mechanism including a first scroll member and a second scroll member.

In some configurations of the compressor of any one or more of the above paragraphs, the lubricant passage is an eccentric lubricant passage, and wherein the driveshaft further comprises a concentric lubricant passage that extends through a lower axial end of the driveshaft and is in fluid communication with the eccentric lubricant passage.

The present disclosure provides a compressor that may include a compression mechanism, a driveshaft, and an oil allocation member. The driveshaft drivingly engages the compression mechanism and includes a lubricant passage. The lubricant passage includes an inlet, a first outlet, and a second outlet. The inlet and the first and second outlets are spaced apart from each other in a direction parallel to a rotational axis of the driveshaft such that the first outlet is disposed vertically higher than the inlet and the second outlet is disposed vertically higher than the first outlet. The oil allocation member may be disposed within the lubricant passage and may be fixed relative to the driveshaft. The oil allocation member may define a first channel, a second channel, and a third channel. The first channel may extend through a lower axial end of the oil allocation member and may receive lubricant flowing upward from the inlet of the lubricant passage. The second channel may receive a first portion of the lubricant from the first channel through an inlet of the second channel and provides the first portion of the lubricant to the first outlet of the lubricant passage. The third channel may receive a second portion of the lubricant from the first channel through an inlet of the third channel and provides the second portion of the lubricant to the second outlet of the lubricant passage. The first portion of the lubricant and the second portion of the lubricant may be separated from each other at a location that is vertically higher than the first outlet.

In some configurations of the compressor of the above paragraph, the location at which the first portion of the lubricant and the second portion of the lubricant are separated from each other is vertically lower than the second outlet.

In some configurations of the compressor of any one or more of the above paragraphs, a lower body portion of the oil allocation member separates the first channel from the first outlet of the lubricant passage.

In some configurations of the compressor of any one or more of the above paragraphs, the oil allocation member includes a divider wall that separates the inlet of the second channel from the inlet of the third channel and restricts fluid communication between the second and third channels.

In some configurations of the compressor of any one or more of the above paragraphs, the third channel extends through an upper axial end of the oil allocation member.

In some configurations of the compressor of any one or more of the above paragraphs, the first outlet of the lubricant passage extends radially outward through an outer circumferential surface of the driveshaft.

In some configurations, the compressor of any one or more of the above paragraphs includes a bearing rotatably supporting the driveshaft.

In some configurations of the compressor of any one or more of the above paragraphs, the first outlet of the lubricant passage is aligned with the bearing to provide lubricant to the bearing.

In some configurations of the compressor of any one or more of the above paragraphs, the second outlet of the lubricant passage extends through an upper axial end of the driveshaft.

In some configurations of the compressor of any one or more of the above paragraphs, the upper axial end of the driveshaft is disposed within a hub of a scroll member of the compression mechanism.

In some configurations of the compressor of any one or more of the above paragraphs, the compression mechanism is a scroll compression mechanism including a first scroll member and a second scroll member.

In some configurations of the compressor of any one or more of the above paragraphs, the lubricant passage is an eccentric lubricant passage, and wherein the driveshaft further comprises a concentric lubricant passage that extends through a lower axial end of the driveshaft and is in fluid communication with the eccentric lubricant passage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
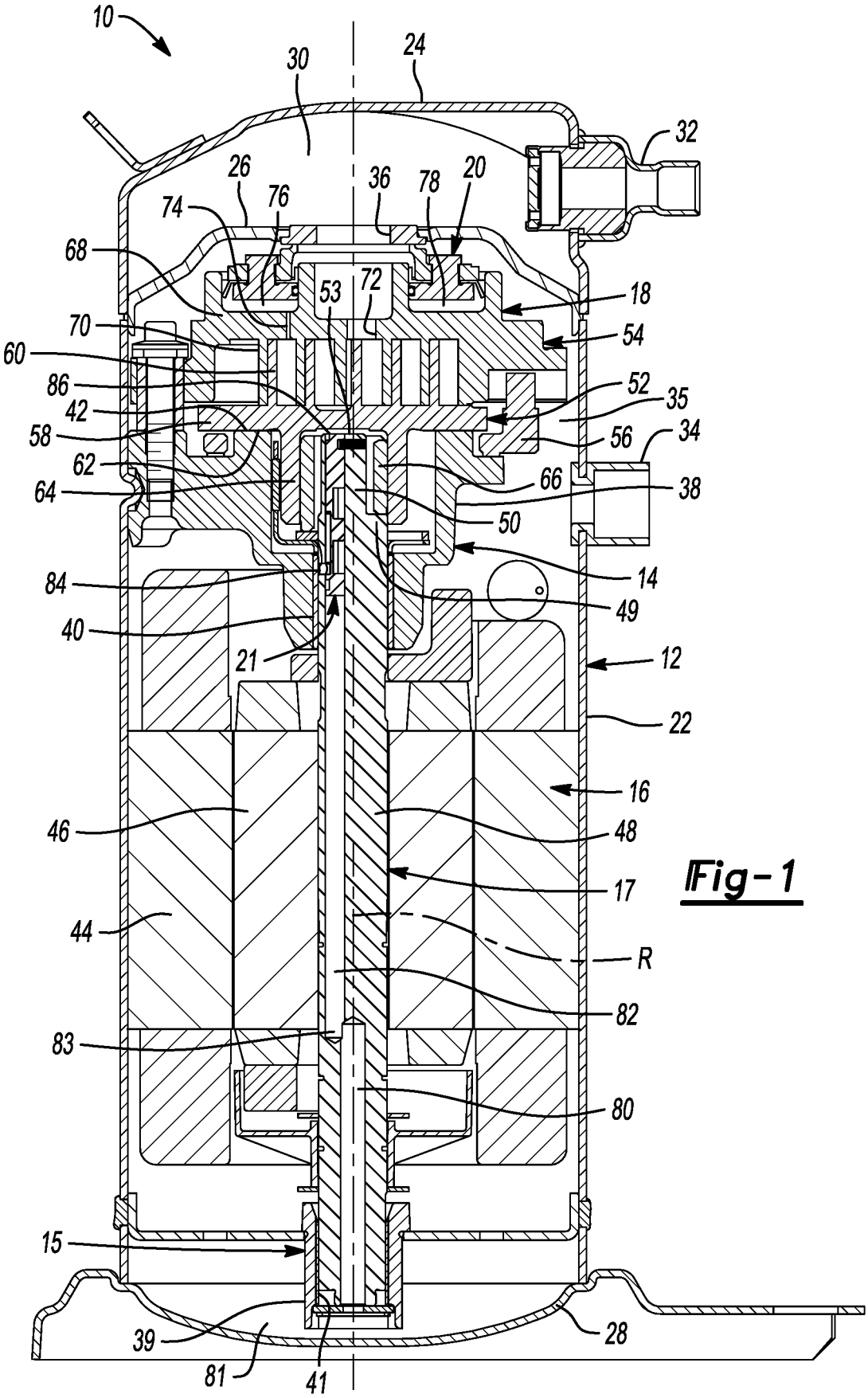
FIG. 1 is a cross-sectional view of a compressor having a driveshaft and an oil allocation member according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a first bearing housing assembly 14, a second bearing housing assembly 15, a motor assembly 16, a driveshaft 17, a compression mechanism 18, and a seal assembly 20. As will be described in more detail below, the driveshaft 17 may include an oil allocation member 21 that divides and distributes oil flowing through the driveshaft 17 in a manner that provides adequate amounts of oil to various components of the compressor 10 at multiple motor speeds.

The shell assembly 12 may generally form a compressor housing and may include a cylindrical shell 22, an end cap 24 at the upper end thereof, a transversely extending partition 26, and a base 28 at a lower end thereof. The end cap 24 and partition 26 may generally define a discharge chamber 30. A discharge fitting 32 may be attached to the shell assembly 12 at an opening in the end cap 24. A suction gas inlet fitting 34 may be attached to the shell assembly 12 at another opening and may communicate with a suction chamber 35 defined by the shell 22 and the partition 26. The partition 26 may include a discharge passage 36 therethrough providing communication between the compression mechanism 18 and the discharge chamber 30.

The first bearing housing assembly 14 may be affixed to the shell 22 and may include a first bearing housing 38 and a first bearing 40. The first bearing housing 38 may house the first bearing 40 therein and may define an annular flat thrust bearing surface 42 on an axial end surface thereof. The second bearing housing assembly 15 may be affixed to the shell 22 and may include a second bearing housing 39 and a second bearing 41. The second bearing housing 39 may house the second bearing 41 therein.

The motor assembly 16 may include a motor stator 44 and a rotor 46. The motor stator 44 may be attached to the shell 22 (e.g., via press fit, staking, and/or welding). The rotor 46 may be attached to the driveshaft 17 (e.g., via press fit, staking, and/or welding). The driveshaft 17 may be driven by the rotor 46 and may be supported by the first and second bearings 40, 41 for rotation about a rotational axis R. In some configurations, the motor assembly 16 is a variable-speed motor. In other configurations, the motor assembly 16 could be a multi-speed motor or a fixed-speed motor.

The compression mechanism 18 may generally include an orbiting scroll 52, a non-orbiting scroll 54 and an Oldham coupling 56. The orbiting scroll 52 may include an end plate 58 having a spiral wrap 60 on the upper surface thereof and an annular flat thrust surface 62 on the lower surface. The thrust surface 62 may interface with the annular flat thrust bearing surface 42 on the first bearing housing 38. A cylindrical hub 64 may project downwardly from the thrust surface 62 and may have a drive bushing 66 rotatably disposed therein. A drive bearing (not shown) may be disposed within the hub 64 and may surround the drive bushing 66. The drive bushing 66 may include an inner bore in which an eccentric crank pin 50 of the driveshaft 17 is drivingly disposed. A flat surface of the crankpin 50 may drivingly engage a flat surface in a portion of the inner bore of the drive bushing 66 to provide a radially compliant driving arrangement. The Oldham coupling 56 may be engaged with the orbiting and non-orbiting scrolls 52, 54 or with the orbiting scroll 52 and the first bearing housing 38 to prevent relative rotation therebetween.

The non-orbiting scroll 54 may include an end plate 68 and a spiral wrap 70 projecting downwardly from the end plate 68. The spiral wrap 70 may meshingly engage the spiral wrap 60 of the orbiting scroll 52, thereby creating a series of moving fluid pockets. The fluid pockets defined by the spiral wraps 60, 70 may decrease in volume as they move from a radially outer position (at a suction pressure) to a radially intermediate position (at an intermediate pressure) to a radially inner position (at a discharge pressure) throughout a compression cycle of the compression mechanism 18.

The end plate 68 may include a discharge passage 72, an intermediate passage 74, and an annular recess 76. The discharge passage 72 is in communication with one of the fluid pockets at the radially inner position and allows compressed working fluid (e.g., at the discharge pressure) to flow into the discharge chamber 30. The intermediate passage 74 may provide fluid communication between one of the fluid pockets at the radially intermediate position and the annular recess 76. The annular recess 76 may receive the seal assembly 20 and cooperate with the seal assembly 20 to define an axial biasing chamber 78 therebetween. The biasing chamber 78 receives fluid from the fluid pocket in the intermediate position through the intermediate passage 74. A pressure differential between the intermediate-pressure fluid in the biasing chamber 78 and fluid in the suction chamber 35 exerts an axial biasing force on the non-orbiting scroll 54 urging the non-orbiting scroll 54 toward the orbiting scroll 52 to sealingly engage the scrolls 52, 54 with each other.

The driveshaft 17 may include a main body 48 and the eccentric crank pin 50. The crank pin 50 may be disposed at a first axial end 49 of the main body 48. The driveshaft 17 may include a concentric lubricant passage 80 and an eccentric lubricant passage 82. The oil allocation member 21 may be disposed within the eccentric lubricant passage 82. The concentric lubricant passage 80 may extend through a second axial end 51 of the main body 48 (i.e., a lower axial end of the driveshaft 17).

Figure 2:
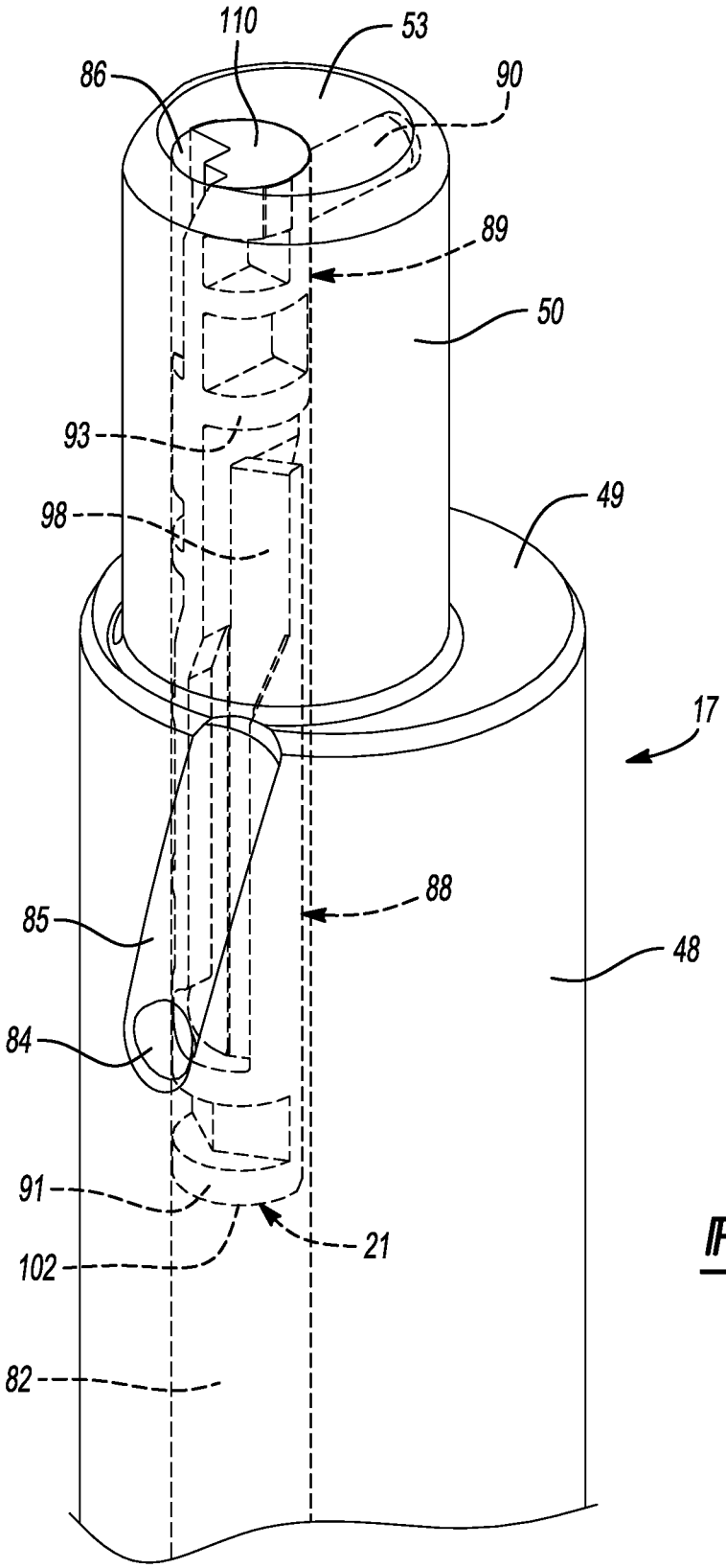
FIG. 2 is a partial perspective view of the driveshaft and oil allocation member.
Figure 3:
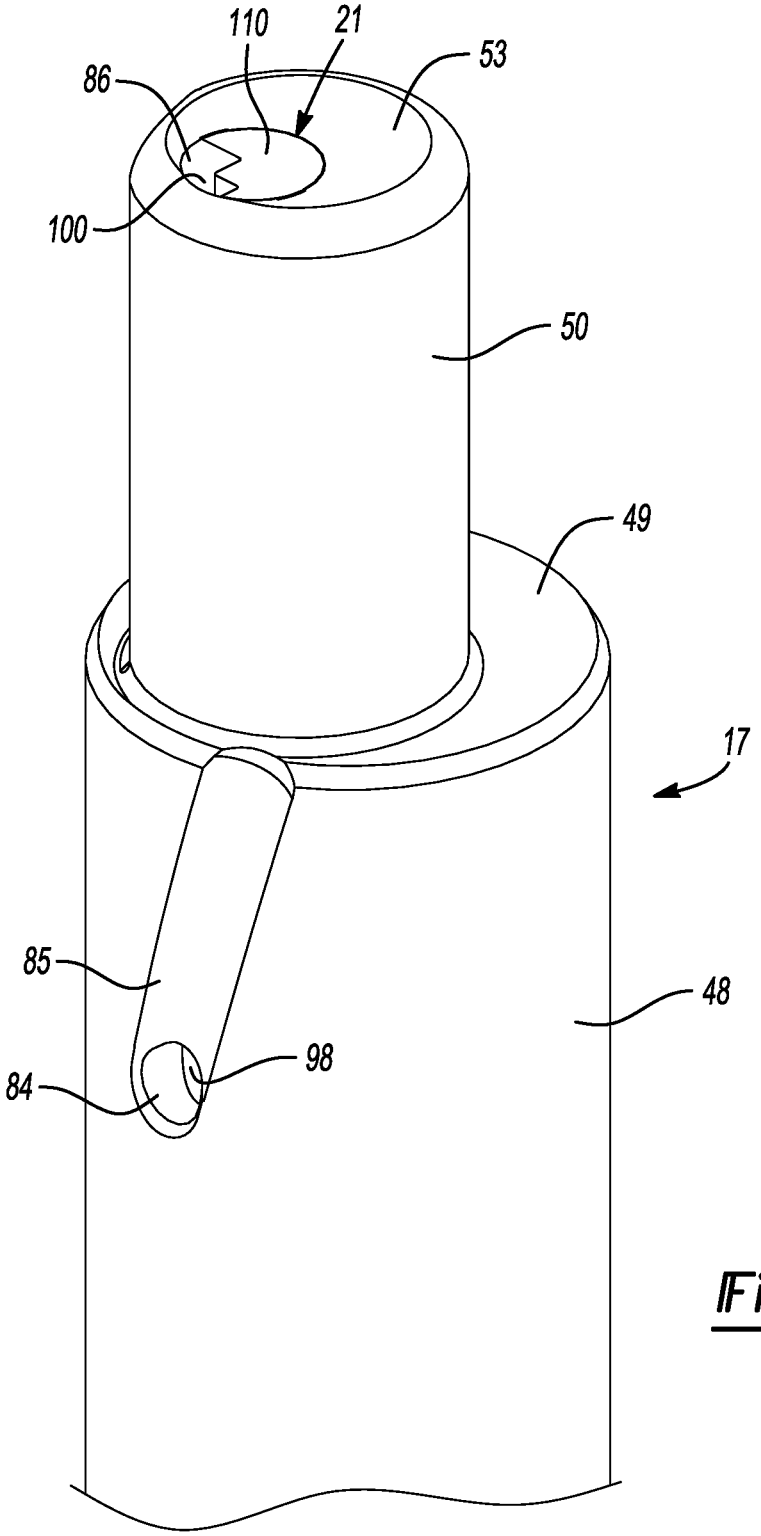
FIG. 3 is another partial perspective view of the driveshaft and oil allocation member.
Figure 4:
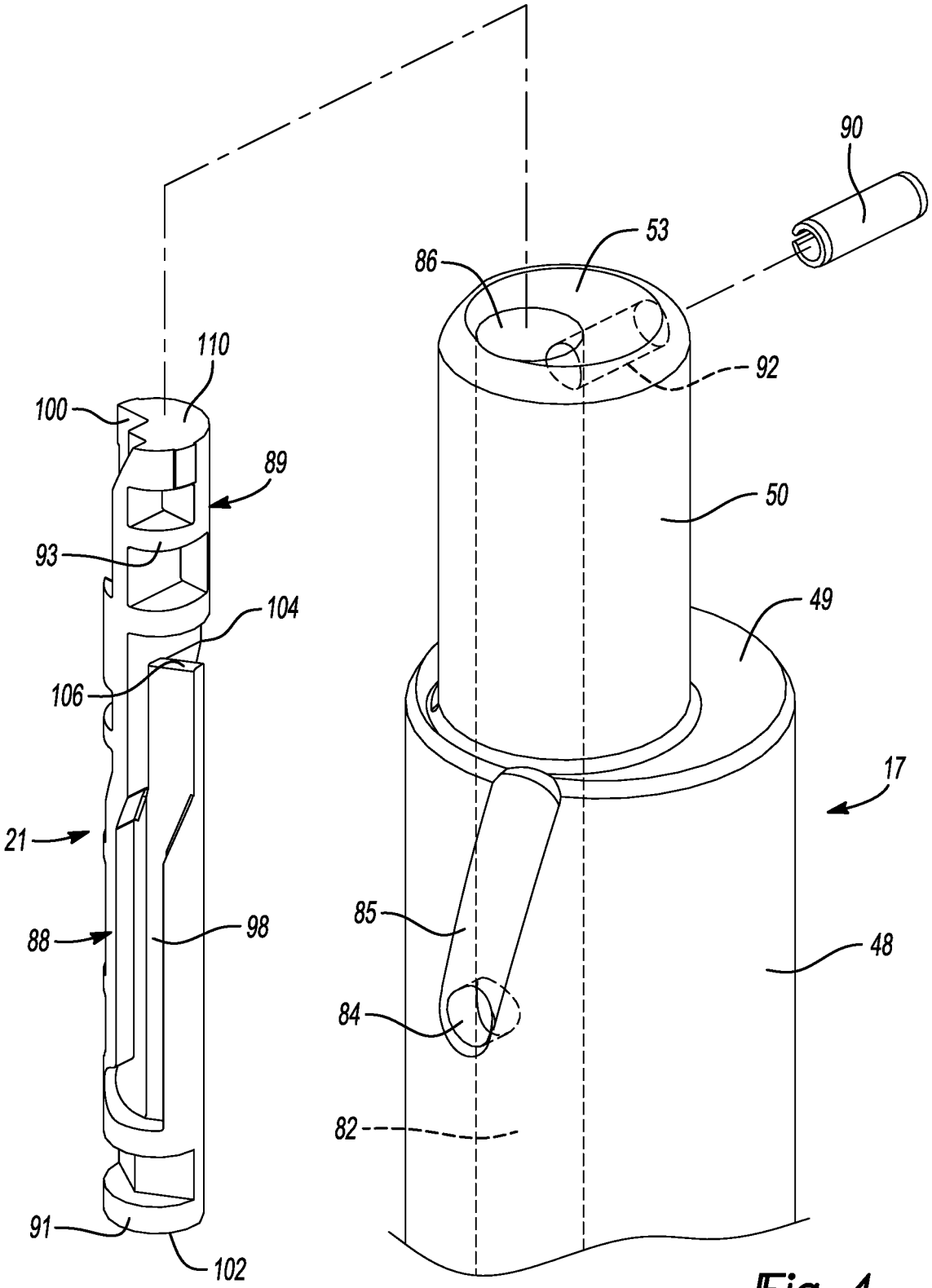
FIG. 4 is an exploded perspective view of the driveshaft and oil allocation member.

The eccentric lubricant passage 82 is in fluid communication with the concentric lubricant passage 80 and extends upward from the concentric lubricant passage 80 and through a distal axial end 53 of the crank pin 50 (i.e., an upper axial end of the driveshaft 17). The eccentric lubricant passage 82 may include an inlet 83, a first outlet 84 and a second outlet 86. The inlet 83 is disposed at the lower end of the eccentric lubricant passage 82 and receives lubricant from the concentric lubricant passage 80. The first outlet 84 may extend radially outward from the eccentric lubricant passage 82 through an outer circumferential surface of the main body 48 of the driveshaft 17 and may be aligned with the first bearing 40 (i.e., a radially extending longitudinal axis of the first outlet 84 may intersect the first bearing 40) so that the first outlet 84 may provide lubricant directly to the first bearing 40. In some configurations, an outer circumferential surface of the main body 48 of the driveshaft 17 may include a groove 85 (FIGS. 2 and 3) that is in fluid communication with the first outlet 84 to aid in distributing lubricant along the first bearing 40. The second outlet 86 is formed in the distal end 53 of the crank pin 50 and provides lubricant to the drive bushing 66 and drive bearing within the hub 64 of the orbiting scroll 52.

While the driveshaft 17 is rotating, lubricant from a lubricant sump 81 (defined by the base 28 of the shell assembly 12) may be drawn into the concentric lubricant passage 80 and may flow into the eccentric lubricant passage 82 and through the first and second outlets 84, 86. The oil allocation member 21: (a) divides the flow of lubricant through the eccentric lubricant passage 82 into first and second portions, (b) channels the first portion of the lubricant in the eccentric lubricant passage 82 to the first outlet 84, and (c) channels the second portion of the lubricant in the eccentric lubricant passage 82 to the second outlet 86.

Referring now to FIGS. 2-9, the oil allocation member 21 may be a generally cylindrical pin including a lower body portion 88 and an upper body portion 89. The oil allocation member 21 may be disposed within the eccentric lubricant passage 82. Diameters of outer circumferential surfaces 91, 93 of the lower and upper body portions 88, 89 may be substantially equal to the diameter of the eccentric lubricant passage 82. In some configurations, a retention pin 90 (FIGS. 4 and 7) or another fastener may extend through a radially extending aperture 92 in the crank pin 50 and into a retention aperture 94 (FIGS. 7 and 9) in the upper body portion 89 of the oil allocation member 21 to fixedly retain the oil allocation member 21 within the eccentric lubricant passage 82. In some configurations, the oil allocation member 21 may be press fit within the eccentric lubricant passage 82.

The lower body portion 88 of the oil allocation member 21 defines a first channel (a first lubricant flow path) 96 (FIGS. 5, 7, and 9) and a second channel (a second lubricant flow path) 98 (FIGS. 4-6 and 8). The upper body portion 89 of the oil allocation member 21 defines a third channel (a third lubricant flow path) 100 (FIGS. 5 and 7-9).

Figure 5:
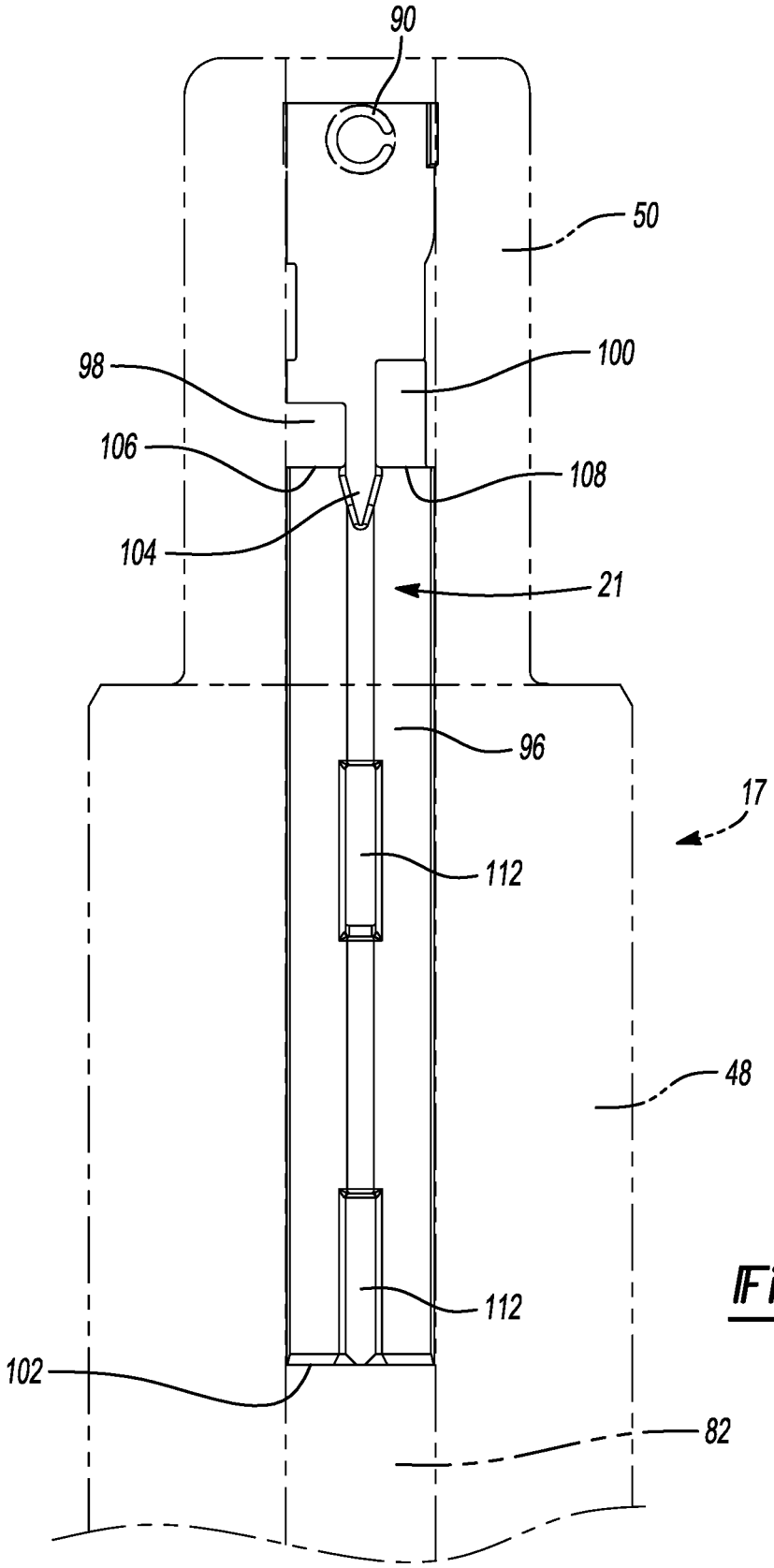
FIG. 5 is a side view of the driveshaft and oil allocation member.

The first channel 96 extends through a lower axial end 102 of the oil allocation member 21 and receives lubricant flowing upward through the eccentric lubricant passage 82 from the inlet 83 of the eccentric lubricant passage 82. The oil allocation member 21 may include a divider wall 104 disposed at the upper end of the first channel 96. As shown in FIG. 5, the divider wall 104 defines an inlet 106 of the second channel 98 and an inlet 108 of the third channel 100. The divider wall 104 separates the second channel 98 from the third channel 100 and restricts fluid communication between the second and third channels 98, 100. The divider wall 104 and the inlets 106, 108 of the second and third channels 98, 100 are located vertically higher than the first outlet 84 of the eccentric lubricant passage 82 and vertically lower than the second outlet 86 of the eccentric lubricant passage 82.

Figure 6:
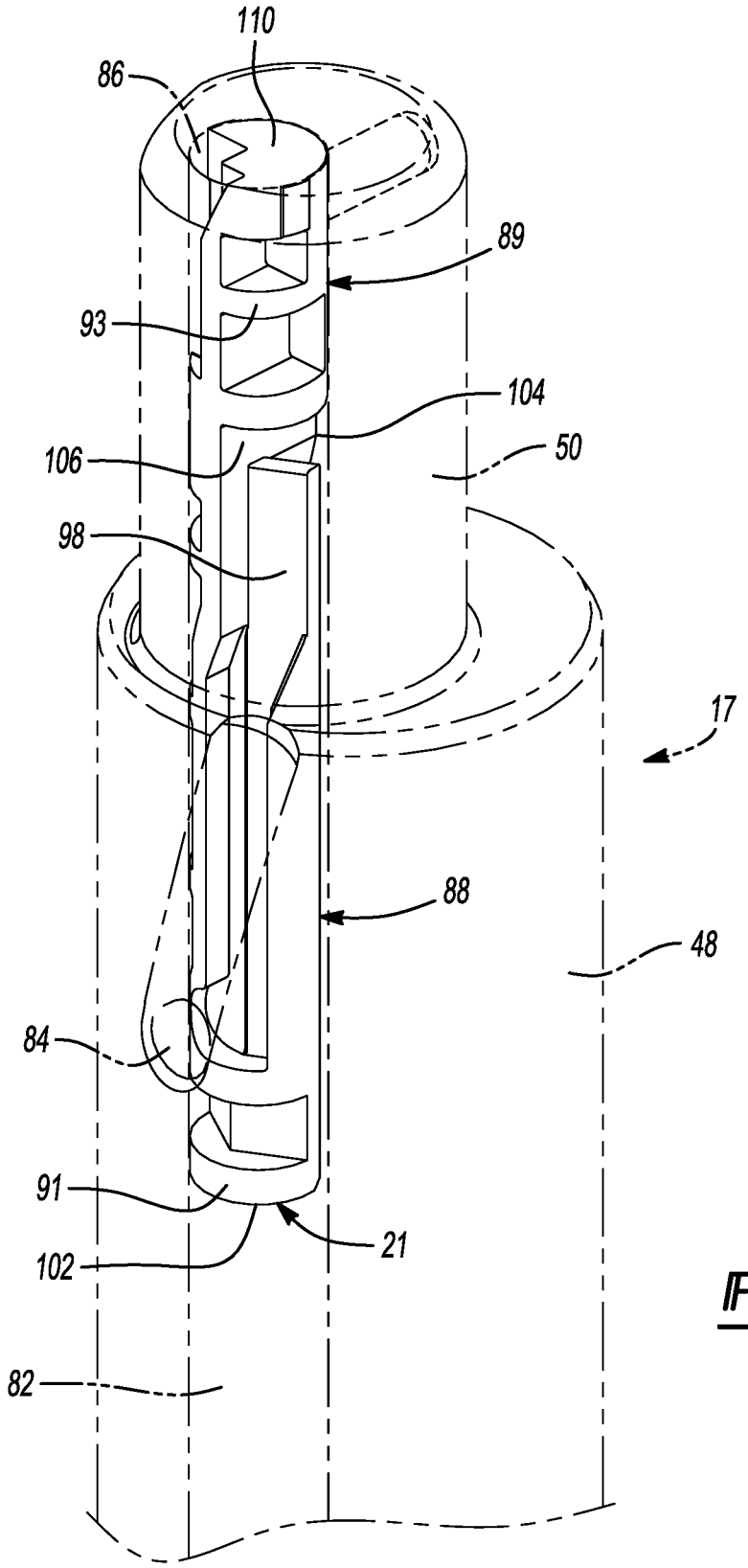
FIG. 6 is another partial perspective view of the driveshaft and oil allocation member.
Figure 7:
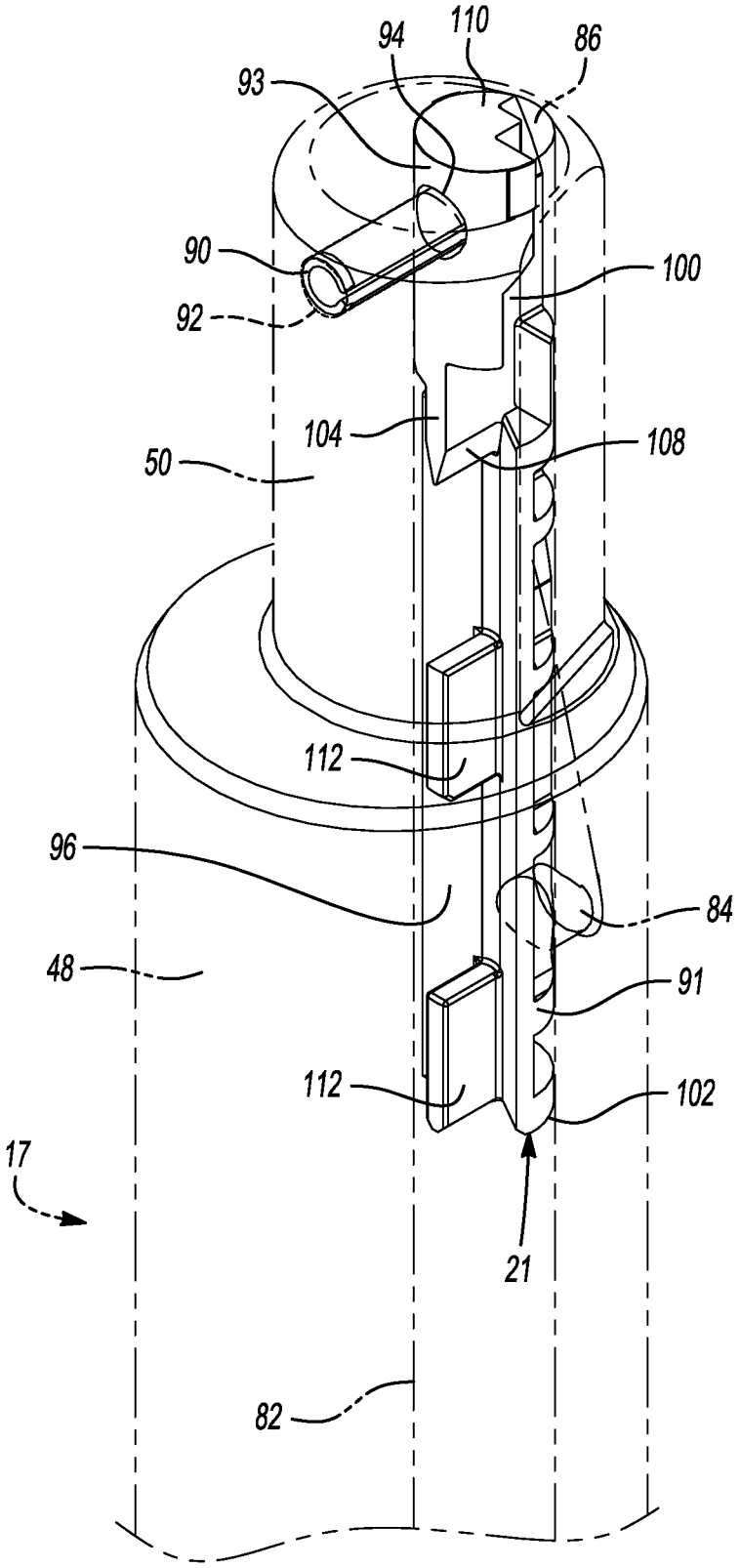
FIG. 7 is yet another partial perspective view of the driveshaft and oil allocation member.
Figure 8:
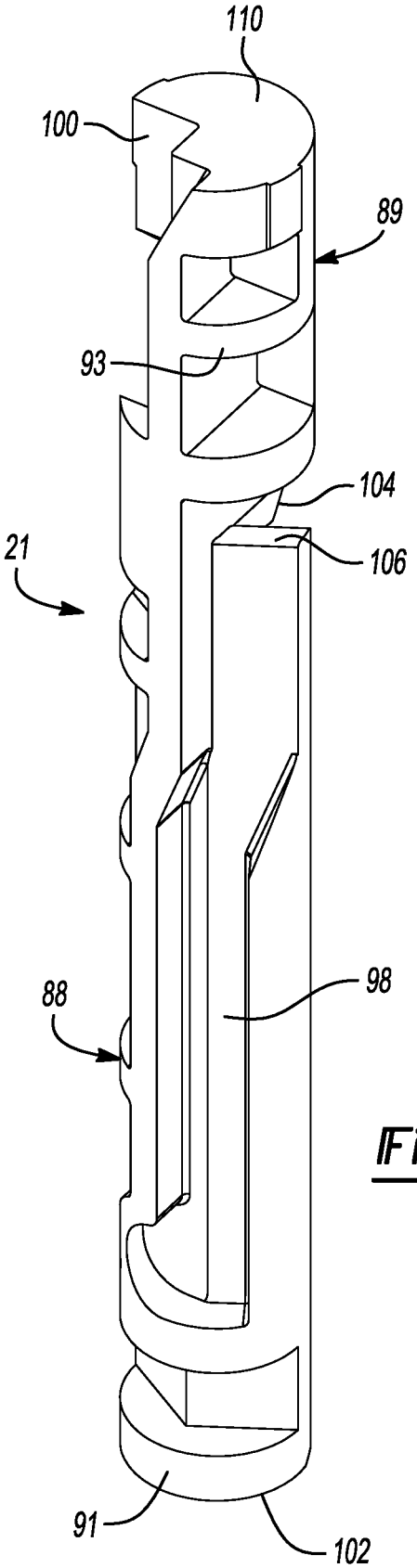
FIG. 8 is a perspective view of the oil allocation member.
Figure 9:
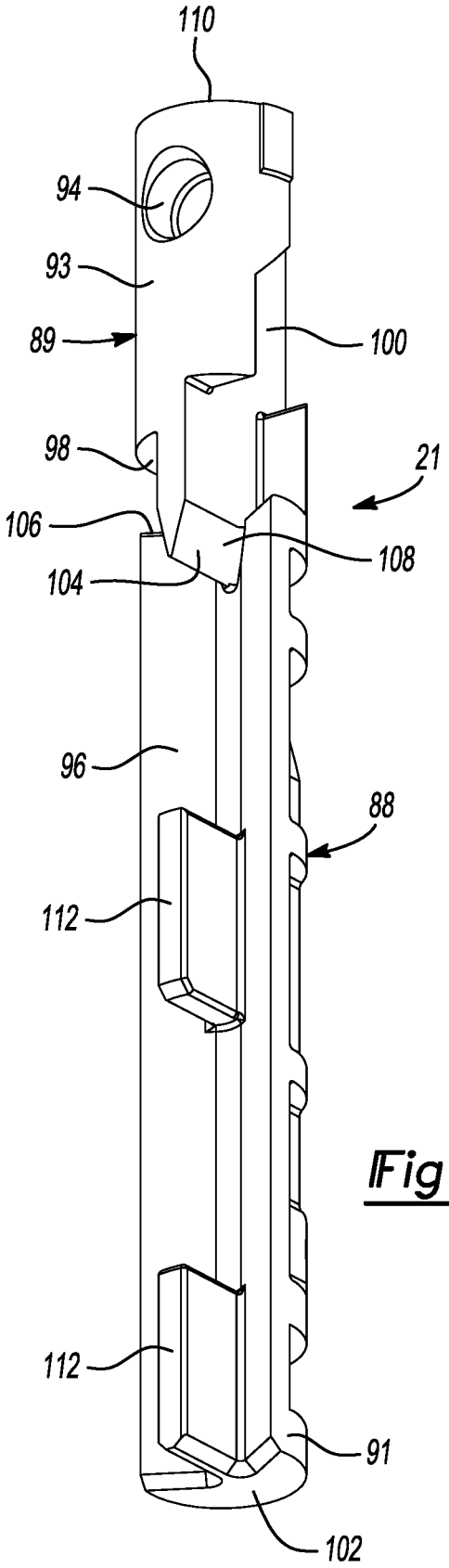
FIG. 9 is another perspective view of the oil allocation member.

As shown in FIG. 6, the second channel 98 extends from its inlet 106 at the divider wall 104 down to the first outlet 84. As shown in FIG. 7, the third channel 100 extends from its inlet 108 at the divider wall 104 up to the second outlet 86 (i.e., the third channel 100 extends through an upper axial end 110 of the oil allocation member 21). The lower body portion 88 of the oil allocation member 21 separates the first channel 96 from the first outlet 84 such that all of the oil that enters the first channel 96 flows upward past the first outlet 84. The divider wall 104 and the upper body portion 89 separate the second channel 98 from the second outlet 86 of the eccentric lubricant passage 82.

During operation of the compressor 10 (i.e., while the driveshaft 17 is rotating), lubricant from the lubricant sump 81 flows into the concentric lubricant passage 80 and into the eccentric lubricant passage 82 via the inlet 83. From the inlet 83, the lubricant flows upward in the eccentric lubricant passage 82 and into the first channel 96 of the oil allocation member 21. The divider wall 104 splits the flow of lubricant in the first channel 96 into first and second portions. The first portion of the lubricant enters the second channel 98 through the inlet 106 and flows down the second channel 98 and through the first outlet 84 to the first bearing 40. The second portion of the lubricant enters the third channel 100 through the inlet 108 and flows up the third channel 100 and through the second outlet 86 to the drive bushing 66. After splitting apart from each other, the oil allocation member 21 keeps the first and second portions of lubricant separated from each other such that only the first portion of the lubricant can flow through the first outlet 84 and only the second portion of the lubricant can flow through the second outlet 86.

In some configurations, the first and second portions of lubricant may be equal in volume (i.e., the divider wall 104 directs half of the lubricant from the first channel 96 to the second channel 98 and directs the other half of the lubricant from the first channel 96 to the third channel 100). In other configurations, the divider wall 104 and the inlets 106, 108 of the second and third channels 98, 100 may be sized and/or positioned to provide more than half of the lubricant from the first channel 96 to one of the second and third channels 98, 100 (i.e., so that one of the first and second portions of the lubricant is greater in volume than the other of the first and second portions). For example, in some configurations, the divider wall 104 may be angled relative to the longitudinal axis of the eccentric lubricant passage 82 to direct more lubricant into one of the second and third channels 98, 100 than the other. Additionally or alternatively, the divider wall 104 could be shifted laterally (i.e., to the left or to the right relative to the position shown in FIG. 5) to direct more lubricant into one of the second and third channels 98, 100 than the other.

As described above, the divider wall 104 and the inlets 106, 108 of the second and third channels 98, 100 are located vertically higher than the first outlet 84 of the eccentric lubricant passage 82 and vertically lower than the second outlet 86 of the eccentric lubricant passage 82. More specifically, the lower tip of the divider wall 104 may be disposed at or vertically above a paraboloid curve formed by lubricant in the eccentric lubricant passage 82 when the driveshaft 17 and motor assembly 16 are operating at a minimum operating speed for the particular compressor 10 in which the oil allocation member 21 is installed. In this manner, at all operating speeds of a given compressor, gravity will force the first portion of the lubricant through the second channel 98 and centrifugal force will force the second portion of the lubricant through the third channel 100.

By splitting the flow of lubricant through the first channel 96 into the first and second portions at a location that is vertically higher than the first outlet 84 and keeping the first and second portions separate from each other, the oil allocation member 21 provides adequate amounts of oil to the first and second outlets 84, 86 regardless of compressor operating conditions such as rotational speed of the driveshaft 17, oil level in the sump 81, oil quality (viscosity, dilution, temperature, etc.), bearing clearance (clearance between the driveshaft 17 and the first bearing 40), refrigerant temperature or pressure above the oil level in the sump 81, etc.

In some configurations, the lower body portion 88 of the oil allocation member 21 may include one or more support members or protrusions 112 (FIGS. 5, 7, and 9) that extend into first channel 96. The protrusions 112 may aid in keeping the lower body portion 88 properly positioned within the eccentric lubricant passage 82 to keep the first channel 96 fluidly separated from the first outlet 84.

While not shown in the drawings, in some configurations, an aperture may extend radially outward from the concentric lubricant passage 80 to provide lubricant to the second bearing 41.

In some configurations, the compressor 10 may include a positive pump to boost the flow lubricant through the lubricant passages 80, 82.

While the compression mechanism 18 is described above as a scroll compression mechanism having orbiting and non-orbiting scrolls, it will be appreciated that the compression mechanism 18 could be other types of compression mechanisms including, for example, a co-rotating scroll mechanism (i.e., with two rotating scrolls), a reciprocating compression mechanism (i.e., with a piston reciprocating within a cylinder), a rotary vane compression mechanism (i.e., with a rotor rotating within a cylinder), or a screw compression mechanism (e.g., with a pair of intermeshed screws).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a compression mechanism;

a driveshaft drivingly engaging the compression mechanism and including a lubricant passage, wherein the lubricant passage includes an inlet, a first outlet, and a second outlet, and wherein the inlet and the first and second outlets are spaced apart from each other in a direction parallel to a rotational axis of the driveshaft such that the first outlet is disposed vertically higher than the inlet and the second outlet is disposed vertically higher than the first outlet; and an oil allocation member disposed within the lubricant passage and fixed relative to the driveshaft, wherein:

the oil allocation member includes a lower body portion and an upper body portion and defines a first channel, a second channel, and a third channel, the first channel extends through a lower axial end of the oil allocation member and receives lubricant flowing upward from the inlet of the lubricant passage, the second channel receives a first portion of the lubricant from the first channel through an inlet of the second channel, the third channel receives a second portion of the lubricant from the first channel through an inlet of the third channel, the inlets of the second and third channels are disposed vertically higher than the first outlet, and the lower body portion of the oil allocation member separates the first channel from the first outlet of the lubricant passage.

2. The compressor of claim 1, wherein the inlets of the second and third channels are disposed between the first and second outlets in the direction parallel to a rotational axis of the driveshaft.

3. The compressor of claim 1, wherein the first portion of the lubricant and the second portion of the lubricant are separated from each other at a location that is vertically higher than the first outlet.

4. The compressor of claim 3, wherein the location at which the first portion of the lubricant and the second portion of the lubricant are separated from each other is vertically lower than the second outlet.

5. The compressor of claim 1, wherein the oil allocation member includes a divider wall that separates the inlet of the second channel from the inlet of the third channel and restricts fluid communication between the second and third channels.

6. The compressor of claim 1, wherein the third channel extends through an upper axial end of the upper body portion.

7. The compressor of claim 1, wherein the first outlet of the lubricant passage extends radially outward through an outer circumferential surface of the driveshaft.

8. The compressor of claim 7, further comprising a bearing rotatably supporting the driveshaft, wherein the first outlet of the lubricant passage is aligned with the bearing to provide lubricant to the bearing.

9. The compressor of claim 7, wherein the second outlet of the lubricant passage extends through an upper axial end of the driveshaft.

10. The compressor of claim 9, wherein the upper axial end of the driveshaft is disposed within a hub of a scroll member of the compression mechanism.

11. The compressor of claim 1, wherein the compression mechanism is a scroll compression mechanism including a first scroll member and a second scroll member.

12. The compressor of claim 1, wherein the lubricant passage is an eccentric lubricant passage, and wherein the driveshaft further comprises a concentric lubricant passage that extends through a lower axial end of the driveshaft and is in fluid communication with the eccentric lubricant passage.

13. A compressor comprising:

a compression mechanism;

a driveshaft drivingly engaging the compression mechanism and including a lubricant passage, wherein the lubricant passage includes an inlet, a first outlet, and a second outlet, and wherein the inlet and the first and second outlets are spaced apart from each other in a direction parallel to a rotational axis of the driveshaft such that the first outlet is disposed vertically higher than the inlet and the second outlet is disposed vertically higher than the first outlet; and an oil allocation member disposed within the lubricant passage and fixed relative to the driveshaft, the oil allocation member defining a first channel, a second channel, and a third channel, wherein:

the first channel extends through a lower axial end of the oil allocation member and receives lubricant flowing upward from the inlet of the lubricant passage, the second channel receives a first portion of the lubricant from the first channel through an inlet of the second channel and provides the first portion of the lubricant to the first outlet of the lubricant passage, the third channel receives a second portion of the lubricant from the first channel through an inlet of the third channel and provides the second portion of the lubricant to the second outlet of the lubricant passage, and the first portion of the lubricant and the second portion of the lubricant are separated from each other at a location that is vertically higher than the first outlet.

14. The compressor of claim 13, wherein the location at which the first portion of the lubricant and the second portion of the lubricant are separated from each other is vertically lower than the second outlet.

15. The compressor of claim 13, wherein a lower body portion of the oil allocation member separates the first channel from the first outlet of the lubricant passage.

16. The compressor of claim 13, wherein the oil allocation member includes a divider wall that separates the inlet of the second channel from the inlet of the third channel and restricts fluid communication between the second and third channels.

17. The compressor of claim 13, wherein the third channel extends through an upper axial end of the oil allocation member.

18. The compressor of claim 17, wherein the first outlet of the lubricant passage extends radially outward through an outer circumferential surface of the driveshaft.

19. The compressor of claim 18, further comprising a bearing rotatably supporting the driveshaft, wherein the first outlet of the lubricant passage is aligned with the bearing to provide lubricant to the bearing.

20. The compressor of claim 19, wherein the second outlet of the lubricant passage extends through an upper axial end of the driveshaft.

21. The compressor of claim 20, wherein the upper axial end of the driveshaft is disposed within a hub of a scroll member of the compression mechanism.

22. The compressor of claim 13, wherein the compression mechanism is a scroll compression mechanism including a first scroll member and a second scroll member.

23. The compressor of claim 13, wherein the lubricant passage is an eccentric lubricant passage, and wherein the driveshaft further comprises a concentric lubricant passage that extends through a lower axial end of the driveshaft and is in fluid communication with the eccentric lubricant passage.

* * * * *